United States Patent [19]

Blomberg

[11] 4,111,004

[45] Sep. 5, 1978

[54] GAS OPERATED REFRIGERATOR HAVING A SEALED COMBUSTION SYSTEM WITH SEPARATED FRESH AIR AND COMBUSTION GAS CONDUITS

[75] Inventor: Peter Erik Blomberg, Stockholm, Sweden

[73] Assignee: Aktiebolaget Electrolux, Stockholm, Sweden

[21] Appl. No.: 627,083

[22] Filed: Oct. 30, 1975

[30] Foreign Application Priority Data

Nov. 1, 1974 [SE] Sweden ..... 7413780

[51] Int. Cl.[2] ..... F25B 15/00

[52] U.S. Cl. ..... 62/476; 98/48; 126/85 B

[58] Field of Search ..... 62/148, 476; 98/48, 98/32, 8, 37, 62, 83; 431/215; 126/110 R, 85 B; 285/137 R

[56] References Cited

U.S. PATENT DOCUMENTS

| | | | |
|---|---|---|---|
| 2,287,743 | 6/1942 | McPartland | 98/62 |
| 2,711,683 | 6/1955 | Ryder | 98/48 |
| 2,998,764 | 9/1961 | Bedell et al. | 126/85 B X |
| 3,105,432 | 10/1963 | Chamberlain | 98/48 X |
| 3,295,334 | 1/1967 | Hultgren | 62/148 |
| 3,521,582 | 7/1970 | Liden | 126/85 B |
| 3,668,889 | 6/1972 | Magnusson et al. | 62/476 |
| 3,741,194 | 6/1973 | Herron | 126/85 B |
| 3,935,855 | 2/1976 | Van Vliet | 126/110 R |

FOREIGN PATENT DOCUMENTS

| | | | |
|---|---|---|---|
| 859,308 | 1/1961 | United Kingdom | 126/85 B |

*Primary Examiner*—William E. Wayner
*Assistant Examiner*—William E. Tapolcai, Jr.
*Attorney, Agent, or Firm*—Alfred E. Miller

[57] ABSTRACT

A heat operated refrigerator having a gas burner and a flue pipe, a fresh air intake conduit and a combustion gas conduit connected to the flue pipe, with the gas burner, flue pipe, and conduits forming a sealed combustion system that is separated from the space to be cooled. The fresh air intake conduit and the combustion gas conduit are so constructed and arranged to pass through a wall or roof whereby upon movements of the air about the ends of the conduits adjacent to the atmosphere a higher static pressure prevails in the opening of the fresh air conduit than in the opening of the combustion gas conduit. Thus, the ambient air variations in pressure do not affect the air flow through the sealed combustion system to such an extent that the burner flame is extinguished.

2 Claims, 6 Drawing Figures

GAS OPERATED REFRIGERATOR HAVING A SEALED COMBUSTION SYSTEM WITH SEPARATED FRESH AIR AND COMBUSTION GAS CONDUITS

BACKGROUND OF THE INVENTION

It is known to provide a refrigerator operated by a gas burner for use in house trailers, boats, and the like. The conduits supplying combustion air to the gas burner and fresh air to the space or room in which the apparatus is mounted, as well as the conduits leading the combustion gases away from the gas burner, are of different design. Since the combustion gases can be injurious to people present in the room in which the apparatus is mounted and since the burner flame involves risk of fire in the event there are combustible gases in the room, strong efforts have been made in prior construction to provide a sealed combustion system. In such a known system, the combustion air, which is led from the ambient to the gas burner, as well as the combustion gases, are conveyed through a system of conduits. This system communicates only with the air outside the room and is nowhere in communication with the atmosphere present in the room.

A number of sealed combustion systems have already been produced and are on the market, but the known constructions are not fully satisfactory with regard to operational safety. Both house trailers and boats are subject to strong winds and/or comparatively strong air gusts occurring in different directions, and hence the pressure conditions in a sealed combustion system can change in such a manner that the flow of air and combustion gas occasionally ceases and the flame goes out due to lack of oxygen. Theoretically, this occurrence could be remedied in two ways: either by providing automatic re-lighting when the flame has extinguished, or by forming the sealed system and its connection to ambient air in such a way that changes of the pressure conditions outside the space or room cannot affect the flow through the sealed combustion system to such an extent that the burner flame is extinguished.

The known ventilators for the previously described apparatus which are now available are improvements compared with what was obtainable earlier. However, they are not entirely windproof. A prime difficulty in preventing a break in the operation of a gas burner in a sealed combustion system depends on the fact that air gusts occur in different directions and that the force of the wind may vary considerably. Therefore, a ventilator of this type cannot have a protecting device which is asymmetric. Furthermore, it must not be possible for the combustion gases dischaged from the system to be blown or led into the air intake so that the burner will get an inappropriate or insufficient quantity of air for combustion purposes. Furthermore, it is not desired that the combustion gases pass through the combustion gas conduit back to the burner, which in such a case would not receive any air for the combustion and its flame would thus be extinguished.

It is an object of the present invention to provide a sealed combustion system for the gas burner of a refrigerator, or the like, with a construction and arrangement whereby the intermittent operation of the burner is overcome due to the changing pressure conditions of the atmospheric air surrounding the ends of the combustion gas conduit and the air intake conduits adjacent to the ambient .

The invention will now be more fully described with reference to the accompanying drawings, in which.

DESCRIPTION OF THE PREFERRED EMBODIMENT OF THE INVENTION

Figure 1:
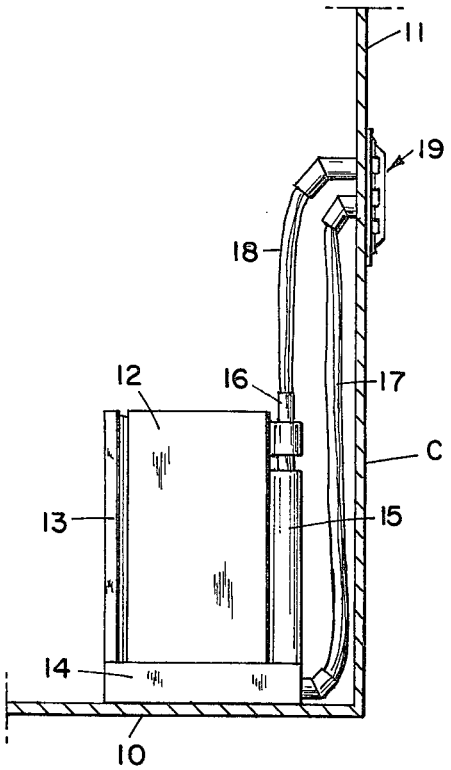
FIG. 1 is a vertical sectional view through a part of a house trailer showing diagrammatically the sealed system and conduits from a refrigerator to a ventilator mounted in the wall of the trailer, all in accordance with the teachings of my invention.

Referring to FIG. 1, a house trailer C is partially shown with a floor 10 and a wall 11. The refrigerator 12 with a door 13 is shown mounted on a hollow base 14 which may house conduits and control means for an absorption refrigerating apparatus 15 operated by a gas burner (not shown) from which combustion gases are discharged by a flue 16.

Combustion air is supplied to the gas burner from outside the trailer through a conduit 17 which, for example, can be a flexible metal hose. The combustion gases are led outside of the trailer from flue 16 to a conduit 18, which also can be a flexible metal hose. The two conduits 17 and 18 open into the ambient by a common single wall ventilator referred to by the reference numeral 19 and shown on an enlarged scale in FIG. 2.

Figure 5:
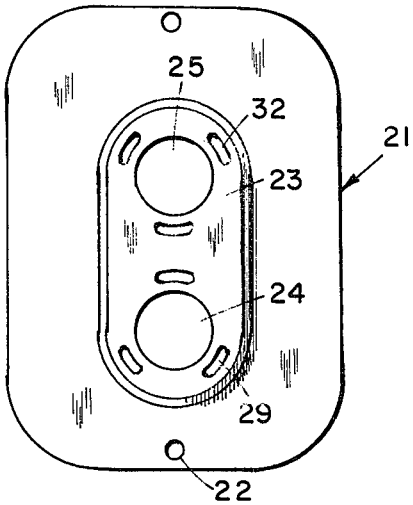
FIG. 5 is a front elevational view of the bottom part of the ventilator.

The ventilator 19 is shown mounted over a hole 20 in the wall 11 and the hole is covered by a bottom part or plate 21 which is shown in detail in FIG. 5 and comprises a plate with two holes 22 for passage of attachment screws therethrough. The bottom plate has a recessed portion 23 which fits into the hole 20 and is provided with two holes 24 and 25. An angular pipe bend 26 of an air conduit fits into the lower hole 24. The opening 27 of the pipe 26 is flush with the exterior surface of the wall 11. Immediately adjacent to the inside of the bottom part 21, the pipe 26 has a flange 28 with holes for screws fitting into corresponding holes 29 in the bottom part. The pipe 26 is thus fastened to the bottom part 21 on assembly. In a similar way, an angular pipe bend 30 located above the pipe 26 is inserted through the upper hole 25 and is connected to the combustion gas conduit 18. The opening 31 of the pipe 30 projects a slight amount out of the hole 25 and the pipe is attached to the bottom part 21 by means of screws passing through holes 32 in the bottom part and corresponding holes in a flange 33 of the pipe 30.

Figure 2:
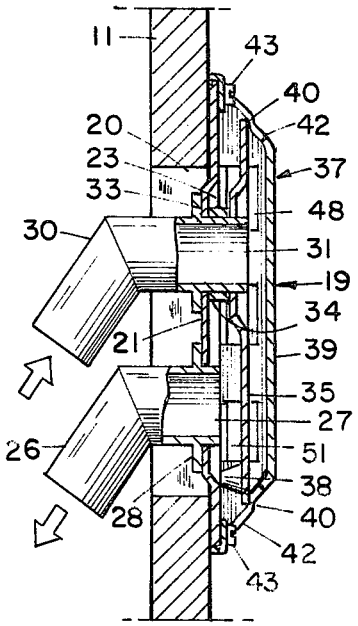
FIG. 2 is a sectional view, on a larger scale, of certain details of construction shown in FIG. 1, and showing the connection of the conduits to the ventilator.
Figure 6:
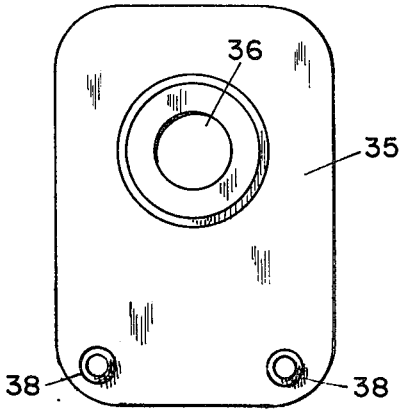
FIG. 6 is a front elevational view of the intermediate disc member of the ventilator.

A spacing and sealing ring 34 is located around the outer end of the pipe 30. This ring is, for example, fabricated of silicon rubber and is positioned between the bottom part 21 and an intermediate disc 35. The disc 35 is provided with a hole 36 (FIG. 6) fitting about the opening 31 of the combustion gas conduit 18. The opening 31 should be at a distance of 5–12 mm. and preferably about 8 mm. from the exterior surface of the wall 11. As shown in FIG. 2, the intermediate disc 35 is retained by a casing 37 of the ventilator. The intermediate disc 35 is maintained in a parallel position relative to the wall 11 by indented projections 38 in its lower part and by the sealing ring 34. It is also secured by the outer casing 37 whose central portion 39 is generally planar and whose edge portions have a ledge 40 lying over the peripheral edge of the intermediate disc 35. The entire periphery of the intermediate disc is in contact with the casing except at such places in which the edge portions of the casing have openings 41 and 42 to the ambient. As seen in FIG. 2, the casing 37 is fastened to the wall 11 by screws 43 and thus holds the ventilator with its accessories in place.

Figure 4:
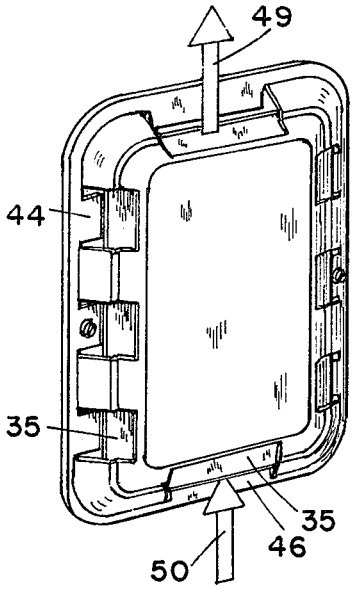
FIG. 4 is a perspective view of the ventilator as seen from the exterior of the trailer.
Figure 3:
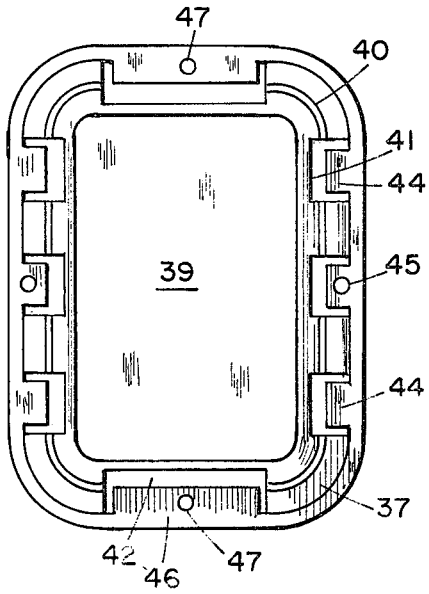
FIG. 3 is a front elevational view of the ventilator as seen from the exterior of the trailer.

As seen in FIGS. 3 and 4, lugs 44 are cut out from the lateral edge portions of the casing and bent down. In certain parts thereof, they have holes 45 for passage of attachment screws. In a similar manner, the lugs 46 are cut out at the top and bottom edge portions. The lugs are thereafter bent inwardly and have holes 47 for the attachment screws 43. For the sake of clarity, only the upper and the lower opening 42 in the casing 37 are shown in FIG. 2. Although the openings 41 are omitted in the figure, they perform exactly the same function as the upper and the lower openings 42. When the gas burner is in operation, combustion gas passes through the conduit 18, the pipe 30, the pipe opening 31, and a disc-shaped space 48 located between the intermediate disc 35 and the central casing portion 39 and passes out through the openings 42 in the casing.

When there is no wind in the area of the trailer, the combustion gases will rise virtually straight upwardly as shown by the arrow 49 in FIG. 4 because the ventilator is warmer than the ambient air. If there is some wind, part of the combustion gases will be drawn out at the lee side of the ventilator. It would, however, be almost impossible for the combustion gases to flow back into the ventilator and down through the conduit 18 toward the burner.

During operation of the burner combustion air is drawn in, preferably as shown in FIG. 4 by the arrow 50, at the bottom part of the ventilator and between the wall 11 and the intermediate disc 35. Then the air passes through the opening 27 of the pipe 26 and through the conduit 17 to the burner. The air passes through a disc-shaped space 51 behind the intermediate disc 35 which separates the incoming air from the combustion gases in the space 48, at the front side of the disc. The present unique ventilator ensures that combustion gases and fresh air are separated and there will be no risk that the combustion gases will enter the air conduit thereby causing the burner flame to go out. When the wind blows more or less parallel to the wall surface, the air can enter through the corresponding openings 41 at one side of the ventilator and leave through the corresponding openings at the other side without harmfully affecting the static pressure in the conduit openings 27 and 31.

The velocity diagram of the air flow along the outside wall of the trailer will be of such a type that the static pressure is highest immediately adjacent the wall and decreases outwardly. Thus, the static pressure is higher in the fresh air space 51 than in the combustion gas space 48, and an air flow is obtained which all the time goes from the fresh air intake, i.e., the pipe opening 27, in the direction toward the flame, and further to the combustion gas outlet and the pipe opening 31 to the atmosphere. The pressure difference causing this flow, increases with the wind force and can amount to 1–1.5 mm. water column during a storm. This applies also to the wind occurring about a trailer when the trailer is being moved. Gusts or turbulences of the wind, which may occur during movement, or strong wind, cannot cause a higher pressure than 1 mm. water column, on occasional pressure variations, and thus air is always supplied to the flame in the correct direction through the sealed system.

What is claimed is:

1. In a gas-operated refrigerator positioned in a room and provided with a gas burner of low capacity, a flue pipe, an atmospheric air conduit for said gas burner, a combustion gas conduit connected to said flue pipe; said burner, flue pipe and said conduits forming a sealed combustion system separated from said room but communicating with the atmospheric air outside of said room, the improvement comprising: a ventilator arrangement including two pipes passing through a wall or ceiling of said room and communicating with the atmosphere, said pipes being connected to said atmospheric air conduit and said combustion gas conduit respectively, the air intake and the combustion gas outlet in said ventilator are so constructed and arranged relative to each other that upon movement of air about them an air flow is induced from said air intake to said gas burner and thereafter to said combustion gas outlet, said ventilator being provided with a spaced disc and a spaced cover, said cover being provided with a peripheral ledge, and the peripheral edges of said disc engaging and resting against said ledge, said disc and the adjacent exterior surface of said wall defining an inner space while said disc and at least part of said cover forms an outer space which is generally parallel to said inner space, said air intake being substantially in the same plane as the exterior surface of said wall and positioned in said inner space, said combustion gas outlet passing through said inner space and said disc and into said outer space, and said cover being provided with a peripheral part having openings communicating the inner and outer spaces to the ambient, and said combustion gas outlet being located approximately 5–12 mm. beyond the exterior surface of said wall.

2. In a gas-operated refrigerator positioned in a room and provided with a gas burner of low capacity, a flue pipe, an atmospheric air conduit for said gas burner, a combustion gas conduit connected to said flue pipe; said burner, flue pipe and said conduits forming a sealed combustion system separated from said room but communicating with the atmospheric air outside of said room, the improvement comprising: a ventilator arrangement including two pipes passing through a wall or ceiling of said room and communicating with the atmosphere, said pipes being connected to said atmospheric air conduit and said combustion gas conduit respectively, the air intake and the combustion gas outlet in said ventilator are so constructed and arranged relative to each other that upon movement of air about them an air flow is induced from said air intake to said gas burner and thereafter to said combustion gas outlet, said ventilator being provided with a spaced disc and a spaced cover, said disc being provided with projections that engage an adjacent exterior surface of said wall, and a spacing and sealing ring located around the outer end of said combustion gas outlet, said projections and said ring functioning to maintain said disc in a parallel relationship to the exterior surface of said wall to maintain said inner space, said disc and the adjacent exterior surface of said wall defining an inner space while said disc and at least part of said cover forms an outer space which is generally parallel to said inner space, said air intake being substantially in the same plane as the exterior surface of said wall and positioned in said inner space, said combustion gas outlet passing through said inner space and said disc and into said outer space, and said cover being provided with a pheripheral part having openings communicating the inner and outer spaces to the ambient, and said combustion gas outlet being located approximately 5–12 mm. beyond the exterior surface of said wall.

* * * * *